United States Patent [19]

Johnson

[11] 3,968,618

[45] July 13, 1976

[54] METHOD OF CONSTRUCTING A FOLDABLE BUILDING WITH BEAM ROOF AND RIGID FRAME

[76] Inventor: Delp W. Johnson, 240 Oakview Drive, San Carlos, Calif. 94070

[22] Filed: May 31, 1974

[21] Appl. No.: 474,937

[52] U.S. Cl. ..... 52/745; 52/69; 52/71; 52/122

[51] Int. Cl.[2] ..... E04B 1/00; E04G 21/14

[58] Field of Search ..... 52/745, 747, 741, 69, 52/71, 122, 125, 126, 227, 285

[56] References Cited

UNITED STATES PATENTS

| | | | |
|---|---|---|---|
| 3,494,092 | 2/1970 | Johnson et al. | 52/122 X |
| 3,600,870 | 8/1971 | Greenhalgh | 52/745 |
| 3,808,754 | 5/1974 | Bottjer et al. | 52/745 X |
| 3,849,952 | 11/1974 | Hanaoka | 52/745 |

FOREIGN PATENTS OR APPLICATIONS

| | | | |
|---|---|---|---|
| 82,772 | 5/1957 | Denmark | 52/745 |

*Primary Examiner*—J. Karl Bell
*Attorney, Agent, or Firm*—Phillips, Moore, Weissenberger, Lempio & Strabala

[57] ABSTRACT

A method and means is disclosed for the construction of clearspan foldable building structures, in which structural beams, capable of spanning the desired distance, are assembled on top of and pivotally connected to supporting units arranged in a horizontal plane; and lifting the beams causes the mid span of the beams to deflect upward and the supporting units to be lifted up and rotated into a generally vertical position; in which position the supporting unit is rigidly connected to the beams and the assembly is placed in position and anchored to the foundation of the structure; and releasing the lifting force permits the beams to deflect down at midspan and develop a resisting moment at each connection to the supporting units.

4 Claims, 18 Drawing Figures

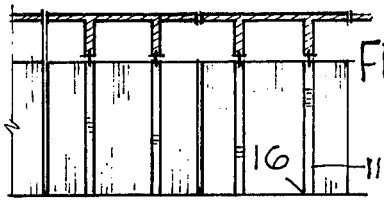
FIG. 6A
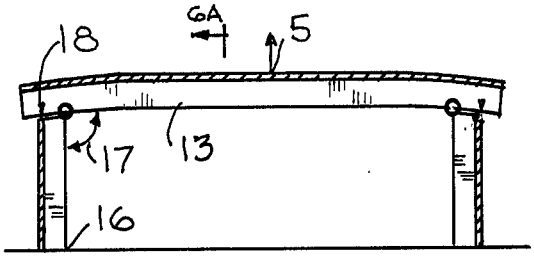
FIG. 6
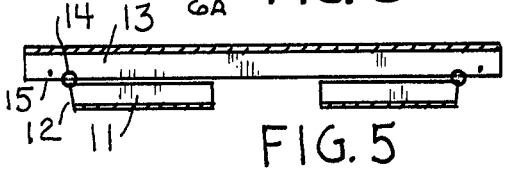
FIG. 5
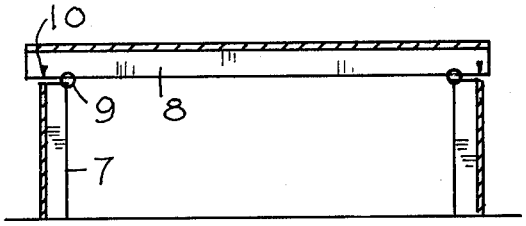
FIG. 4
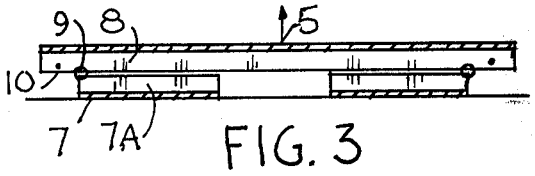
FIG. 3
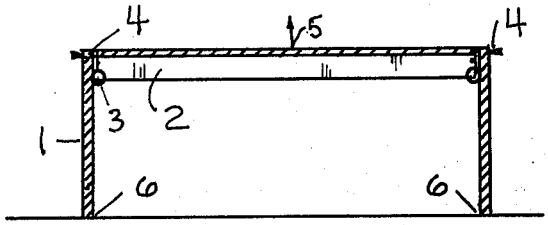
FIG. 2
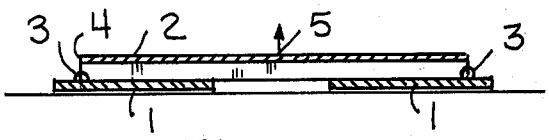
FIG. 1
FIG. 10A
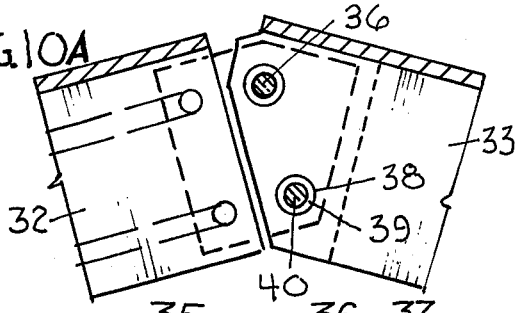
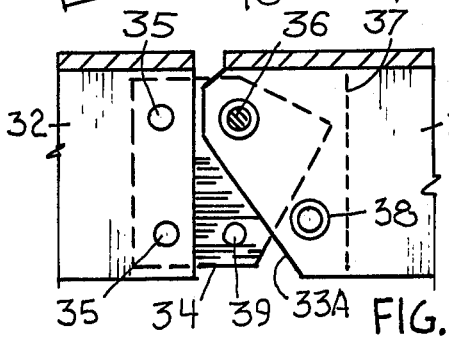
FIG. 10
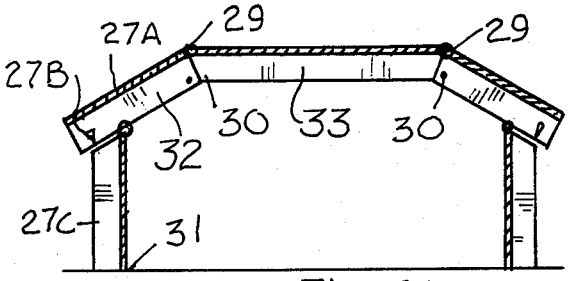
FIG. 9A
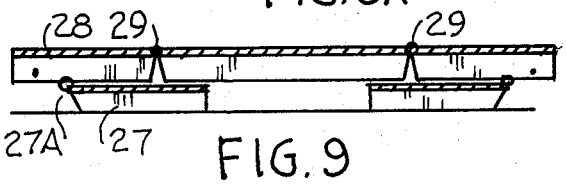
FIG. 9
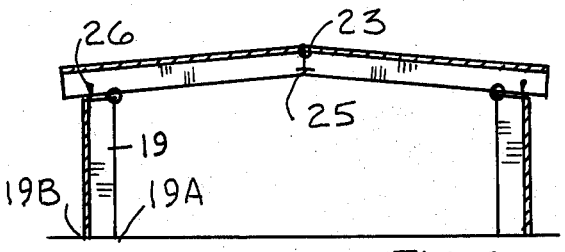
FIG. 8
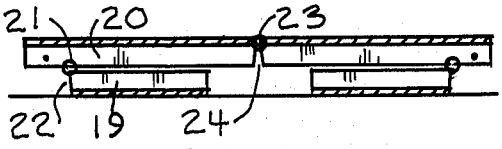
FIG. 7

METHOD OF CONSTRUCTING A FOLDABLE BUILDING WITH BEAM ROOF AND RIGID FRAME

BACKGROUND OF THE INVENTION

In the development of foldable building structures for clearspans, various methods have been developed including foldable beams dependent from roof slabs, and various foldable plate designs; and also methods of job forming deep section roofs or floors in combination with wall sections. These methods have resulted in high labor costs for on site work for the roofs and floors, and have largely destroyed the cost savings of the folding method of assembly and erection. In addition, the lifting strongbacks required to support the roof or floor until supportive folding action had been completed, were not readily available and very costly.

In addition, there had been no method to easily erect the buildings without considerable bracing of the individual sections until the entire structure had been erected.

It is the object of this invention to provide a means for and method of utilizing structural beams as the means of lifting the supporting walls; by rigidly connecting beams to walls so that individual sections are rigid and do not require additional bracing or shoring, and further to utilizing the deflections that occur during the lifting to introduce bending moment into the rigid connections to develop a rigid frame for the section of the building and thus reduce the size of the members required for the clear spans.

SUMMARY OF THE INVENTION

This invention provides a means of and method for constructing clear span rigid frame buildings by a folding technique, which method may utilize various materials as on site cast concrete, factory produced concrete sections, sandwich panels, steel sections, wood sections, and combinations of them.

Thus, it is possible to construct a building utilizing ordinary tilt-up walls formed and cast on the site, arranged along the sides of the building to be enclosed, and providing in these walls one part of the pivot connection; then to bring from a prefabricating plant, precast "tee", or double "tee" or channel roof sections which have been provided with the matching portion of the pivot connections; Lifting the precast sections into position over pairs of wall sections, completing the pivot connection, then proceed immediately with the same lifting rig to lift the section into position in the building; first anchoring the connection between the beam and the supporting unit, then lowering and anchoring to the foundation, and then releasing the lifting rig; and proceed with the next unit until the entire building structure is erected. It can be seen that this would save one handling step for each unit, would eliminate bracing and shoring, would produce a rigid frame for each section of the building. It would further eliminate the type of forming that would be required for such a roof section, and would permit utilizing of pretensioned concrete sections for the roof members. This would also save time in the total job since the roof sections could be manufactured while the wall sections were being job cast.

A building might also be constructed with walls job cast as above and utilize glue laminated beams for the roof structure, and while the wall concrete was curing, the roof framing could be completed.

Such a building might be entirely fabricated at the plant, with supportive units assembled to the roof sections with the pivot connection, and so delivered to the job site, where the crane would lift a unit from the truck, and place it in position in the building structure.

This invention provides a novel means by which beam sections can be assembled with supportive units in horizontal planes, then the beam sections utilized as the lifting strongbacks to lift the supportive units into a vertical position, the means of joining the beams to the supportive walls with a rigid connection, and the means to utilize the deflection of the beams induced by the lifting action, to introduce bending moment into the rigid connections.

BRIEF DESCRIPTION OF THE DRAWINGS

FIG. 1. section of a building section with beam and supporting units assembled in a horizontal position.

FIG. 2. section of the building of FIG. 1, in the lifted position.

FIG. 3. section of a building with beam overhanging supportive units,

FIG. 4. section of the building of FIG. 3, in the lifted position.

FIG. 5. section of a building in the assembled position, showing tops of supporting units shaped to an angle greater than 90°.

FIG. 6. section of the building of FIG. 5 in the lifted position with the supporting units forced into a vertical position.

FIG. 6A. section taken along lines 6A—6A of FIG. 6.

FIG. 7. section of a building in which the beam is composed of two pivotally connected sections.

FIG. 8. section of the building of FIG. 7 in the lifted position.

FIG. 9. section of a building in which the beam is composed of three pivotally connected sections.

FIG. 9A. section of the building of FIG. 9 in the lifted position.

FIG. 10. Detail of a pivot connection suitable for connecting beam sections, shown in the assembled position.

FIG. 10A. Detail of pivot connection of FIG. 10, shown in the lifted position.

DETAILED DESCRIPTION

Figure 13:
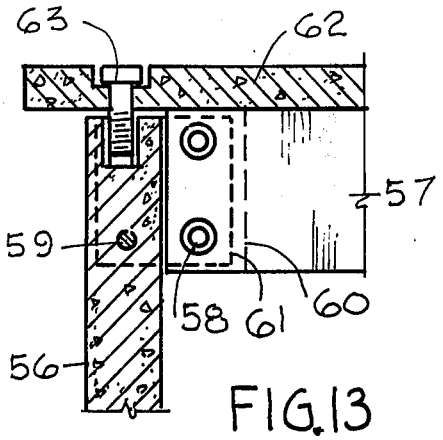
FIG. 13. Detail of beam connection to supporting unit with top portion of beam extended to form "tee" beam and cover building area.

FIG. 1 shows supporting units 1 assembled at the ends of the building section and beam 2 positioned on top of them. Pivot connection 3 connects the beam to the supporting units at each end. Part of the anchor device 4 is located near the end of the supporting unit. FIG. 2 shows the section lifted with the supporting walls pivoting about pivot connection 3, and anchor device 4 securing the supporting wall to the end of beam 2. The lifting force indicated by the arrow 5 will cause the midspan of the beam 2 to deflect upward during the lift. The supporting units 1 are anchored to the foundation at 6 prior to releasing the lifting force 5. FIGS. 1 & 2 show the application to a building where the supporting units are simple tilt up walls.

FIGS. 3 & 4 show supporting units 7 fabricated with pilasters to provide a thickness of at least 12 inches to provide additional stiffness to the unit and the pivot connection 9 connects the stem of the "tee" 8 to the pilaster. FIG. 4 shows the building section lifted with the beam anchored to the supporting unit at 10, to form a rigid connection.

FIG. 5 shows supporting units 11 fabricated with ends 12 fabricated at an angular relation to the plane of unit 11. When the section of the building is lifted, beam 13 deflects up and the anchor device 18 secured. This establishes the angle 17 at greater than 90° and will reduce the downward deflection of the beam after the lifting force is removed.

As shown in FIG. 6, the supporting units 11 are anchored to the foundation at 16 prior to releasing lifting force 5. As shown in FIG. 6A, the beam 13 may be a double "Tee" and the supporting units 11 may be fabricated with corresponding double pilasters.

FIG. 7 illustrates supporting units 19 underlying beam 20 which is fabricated in two sections pivotally connected at 23. End 22 is fabricated at an angle similar to angle at 24. The lifted building section FIG. 8, shows the supporting unit 19 attached to the beam at 26, and the two sections of the beam secured at point 25 to develop a rigid frame. It is noted that the angle at 24 could be made larger in relation to angle at 22, and the anchor 25 ommitted, and this would then develop a three hinge arch; or the supporting unit 19 could be anchored to the foundation at points 19A and 19B to provide additional rigidity to the section.

FIGS. 9 and 9A shows further development of this concept with the beam divided into three sections which are pivotally connected at 29. The building when lifted is connected at 30 and 27B to form a rigid frame. It is noted that in this building the pilasters 27C are shown on the outer face of the wall as a means of providing variety for the design. The same thing is true of all sections and the matter of roof overhang, or extension of wall line above roof line are all subject to the designers discretion. In the preferred application of the invention, the designer would select a section and stiffness for the beam and the supporting units that would utilize a minimum amount of material.

FIG. 10 shows a pivot connection between beam sections 32 and 33, in which plate 34 is cast integrally with beam 32 and anchored thereto with bars passing thru holes 35. Beam 33 is provided with a groove in the end of the beam and the end 33A is shaped to the desired profile required for the folding. Sleeves 38 provide clear holes thru the beam 33 on each side of groove 37. The pin 36 is installed at the time of assembly. After lifting, the pin 40 is installed to make the connection rigid as shown in FIG. 10A. The hole 39 in plate 34 is located the same distance from the center of pivot point 36 as is the center of sleeve 38, so that the pivoting motion will bring the hole 39 into precise alignment.

Figure 12:
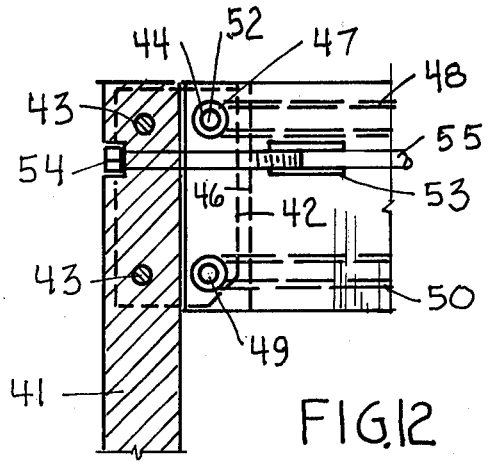
FIGS. 11, 12. Detail of pivot connection between beam and supporting unit, shown in assembled and lifted position.
Figure 11:
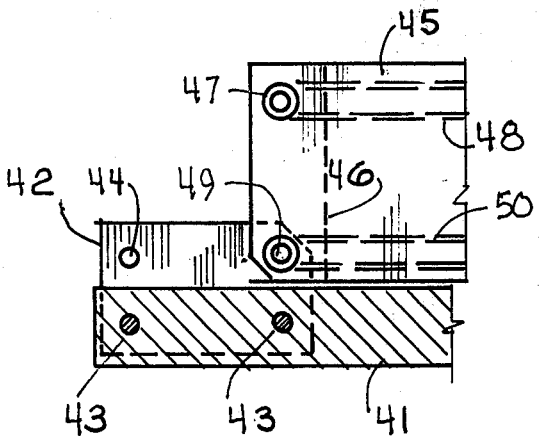

FIG. 11 shows a preferred means for securing a wall 1 to the end of a beam 2 as shown in FIGS. 1 and 2. Thus, the assembled position of supporting unit 41 and the beam unit 45, is shown with plate 42 anchored to unit 41 by bars 43. Pivot point 49 is secured by sleeves anchored to bars 50. A groove 46 is provided in beam 45 in line with plate 42. Hole 44 in plate 42 is located the same distance from the center of pivot 49, as the center of sleeve 47; FIG. 12 shows the plate 42 pivoted up into groove 46 with hole 44 aligned with sleeve 47, and anchor bolt 52 inserted to make the joint rigid. Bars 48 anchor sleeve 47 to the beam. FIG. 12 shows an additional feature in which a bar 55 is embedded in the beam, provided with a threaded sleeve 53, to which a bolt 54 may be secured and thus provide additional rigidity to the connection.

FIG. 13 shows supporting unit 56 connected to beam 57 by plate 61 fitting into groove 60. Supporting unit has been pivoted about point 58, to bring plate into position to secure with bolt 62. This FIG. 13 illustrates the relation of a "tee" beam and shows an additional anchorage between the flange of the beam and the supporting unit by means of bolt 63. The upper bar similar to bar 59, anchoring plate 61 to the supporting unit is ommitted from the drawing for clarity of the drawing.

Figure 14:
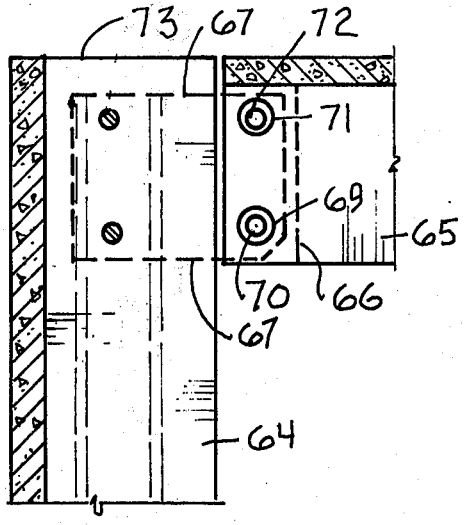
FIG. 14. Detail of beam supported on the "pilaster" of a supportive unit.

FIG. 14 discloses supporting unit 64 pivotally connected to beam 65, by means of plate 67 pivoted into groove 66, and pivoted about point 70. The connection is secured in position by bolt 72 passing thru sleeve 71. Anchor bars to secure sleeves are not shown but would be similar to those shown in other figures. The upper surface 73 is shown exposed in a position that would be suitable for a multiple story structure. It is noted that plate 67 is rigid with respect to the beam 65 and hence the loads of the beam will be transferred to the center of gravity of the supporting unit.

Figure 15:
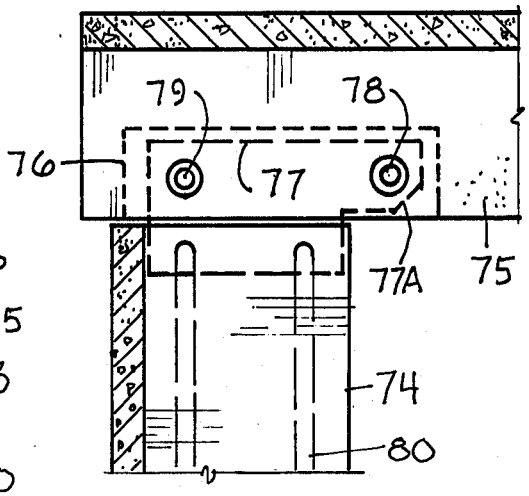
FIG. 15. Detail of "tee" beam supported on top of supporting unit which is also "tee" beam in plan section.

FIG. 15 illustrates a preferred embodiment of the connecting means for use in structures as shown in FIGS. 3 through 9. Thus, supporting unit 74 is located under beam 75 when the structure is fully erected, with groove 76 to receive plate 77. The plate 77 is fabricated with offset 77A to permit the assembly in the horizontal position, and provide for the pivoting movement required. The anchor bolt 79 is used to secure the connection. Bars 80 are provided to secure the required anchorage in the supporting unit.

As shown in FIGS. 11 and 12, the preferred connection consists of:

a. a slot 46 at the end of the web of the Tee beam 45 having a length at least about equal to the depth of the Tee;
b. a first pair of aligned sleeves 49 through the web near one end of the slot on each side thereof;
c. a second pair of aligned sleeves 47 through the web near the other end of the slot at each side thereof;
d. a metal plate 42 that will fit into the slot with close tolerance;
e. two holes 44 through the metal plate 42 spaced from each other by a distance equal to the spacing between the two pairs of aligned sleeves 47, 49;
f. two bolts 52, each of which will fit tightly through the sleeves 47, 49 and the holes 44 in the plate 42.

The manner in which the preferred connection works is as follows:

1. the metal plate 42 is rigidly attached to the wall 41 and is located in line with the slot 46 in the web of the Tee;
2. the web of the Tee of a beam 45 is lowered onto the metal plate 42 so that at least a portion of the metal plate 42 is received within the slot 46 and a pair of sleeves 49 in the web is aligned with a hole 44 in the metal plate 42;
3. a bolt 52 is inserted through the aligned sleeves 49 and hole 44 in the plate 42 to form a pivot joint;

4. the beam 45 is lifted, lifting the wall 41 pivotally connected thereto which rotates by gravity around the pivot joint until it reaches a position in which the metal plate 42 is fully received into the slot 46 with the other hole 44 in the plate 42 aligned with the other pair of sleeves 47 in the web;
5. the second bolt 52 is inserted through such other pair of sleeves 47 and other hole 44 in the metal plate 42 aligned therewith to make a rigid connection between the beam 45 and the wall 41;
6. the lifting force is removed and gravity acting on the beam 45 places the connection in stress to hold the connection rigid.

In the preferred mode of practicing the method of this invention, the lifting of the beam is done in a manner to cause the mid-span of the beam to deflect upward and the ends of the beam to which the supporting walls are attached to deflect downward. The walls are then secured to the foundation in a vertical position thus tending to enclose an angle greater than 90° between the walls and the roof beam. As a result, before the mid-span of the beam can deflect downward when the lifting force is released, a bending moment is transferred through the connection into the wall and the rigidity of the wall resists the downward deflection of the beam thereby providing a rigid frame structure. As shown in FIGS. 10 through 15, the distance by which the pairs of sleeves and the holes in the plate are spaced must be at least about equal to one-half the depth of the beam.

I claim:

1. The method of constructing a clearspan building having an elongated Tee beam roof of given depth comprising the steps of:

a. positioning said Tee beam and a further elongated structural member with major surfaces thereof in parallel planes and the axes of elongation thereof in alignment;
b. establishing a connection between said Tee beam and said further elongated structural member, which connection is pivoted about an axis normal to said axes of elongation thereof;
c. lifting said Tee beam by exerting a lifting force at a limited central portion only of said Tee beam to allow said further elongated structural member to rotate about said pivotal connection;
d. lowering the free end of said further elongated structural member into contact with a foundation; and
e. anchoring said Tee beam and said further elongated structural member to each other by means capable of withstanding both tensile and compressive stress at a point spaced from said pivotal connection by a distance at least about equal to one-half said given depth of said Tee beam and anchoring the free ends of said Tee beam and said further elongated structural member to said foundation whereby the release of said lifting force introduces bending moments into said Tee beam and said wall through said pivotal connection and anchoring means therebetween.

2. The method of constructing a clearspan building having an elongated Tee beam roof of given depth and a pair of walls, each at a different end of said Tee beam, comprising the steps of:

a. positioning said Tee beam and said walls with the major surfaces of said walls lying in a common plane parallel to the plane of the major surface of said Tee beam and with at least a portion of one major surface of each of said walls in contiguous contact with a portion of said Tee beam;
b. establishing connections which are pivotal about parallel axes normal to the axis of elongation of said Tee beam between said Tee beam and each of said walls, each said connection being adjacent a different end of said beam and at the end of said portion of the associated one of said walls which is in contiguous contact with said Tee beam at said end thereof;
c. lifting said Tee beam by exerting a lifting force at a limited central portion only of said Tee beam to allow said walls to pivot downwardly about said pivotal connections to positions in which the major surfaces of said walls extend in planes generally normal to said axis of elongation of said Tee beam;
d. lowering the free ends of said walls into contact with a foundation;
e. anchoring each of said walls to said Tee beam by means capable of withstanding both tensile and compressive stress at a point spaced from said pivotal connection by a distance at least about equal to one-half said given depth of said Tee beam and anchoring the free ends of said walls to said foundation whereby the release of said lifting force introduces bending moments into said Tee beam and said walls through said pivotal connection and anchoring means therebetween.

3. The method of constructing a clearspan building as claimed in claim 2 wherein said step of positioning said Tee beam and said walls comprises the steps of placing said walls on a horizontal surface in end-to-end relation and placing said Tee beam on top of said walls with a portion of each wall projecting beyond the respective end of said Tee beam by a distance at least about equal to said given depth of said Tee beam.

4. The method of constructing a clearspan building as claimed in claim 2 wherein said step of positioning said Tee beam and said walls comprises the steps of forming walls with a thickness at least about equal to said given depth of said Tee beam, placing said walls on a horizontal surface in end-to-end relation and placing said Tee beam on top of said walls with each end of said Tee beam projecting beyond the wall associated therewith by a distance at least about equal to said given depth of said Tee beam.

* * * * *